US006009395A

United States Patent [19]

Lai et al.

[11] Patent Number: 6,009,395

[45] Date of Patent: Dec. 28, 1999

[54] SYNTHESIZER AND METHOD USING SCALED EXCITATION SIGNAL

[75] Inventors: Wai-Ming Lai, Plano; Alan V. McCree, Dallas; Erdal Paksoy, Richardson, all of Tex.

[73] Assignee: Texas Instruments Incorporated, Dallas, Tex.

[21] Appl. No.: 08/999,092

[22] Filed: Dec. 29, 1997

Related U.S. Application Data

[60] Provisional application No. 60/034,169, Jan. 2, 1997.

[51] Int. Cl.[6] ..... G10L 9/18

[52] U.S. Cl. ..... 704/264; 704/219; 704/225

[58] Field of Search ..... 704/219, 222, 704/223, 224, 225, 264

[56] References Cited

U.S. PATENT DOCUMENTS

| | | | |
|---|---|---|---|
| 5,732,389 | 3/1998 | Kroon et al. | 704/223 |
| 5,751,903 | 5/1998 | Swaminathan et al. | 704/230 |
| 5,752,223 | 5/1998 | Aoyagi et al. | 704/219 |

OTHER PUBLICATIONS

Wilfrid LeBlanc, Christine Liu amd Vishu Viswanathan, "An Enhanced Full Rate Speech Coder for Digital Cellular Applications," IEEE 1996, pp. 1–4.

*Primary Examiner*—Susan Wieland
*Attorney, Agent, or Firm*—Robert L. Troike; Richard L. Donaldson

[57] ABSTRACT

A synthesizer may synthesize speech by receiving an adaptive codebook excitation signal and an adaptive codebook gain. The adaptive codebook excitation signal may be scaled using the adaptive codebook gain to generate a scaled adaptive codebook excitation signal. A fixed excitation signal and a fixed excitation gain may also be received. The fixed excitation signal may be scaled using the fixed excitation gain to generate a scaled fixed excitation signal. The scaled adaptive codebook excitation signal and the scaled fixed excitation signal may be combined to generate the excitation signal having a first word length. An overall gain signal of the excitation signal may also be received. A scaled excitation signal may then be generated by scaling the excitation signal using the overall gain signal. The scaled excitation signal may have a second word length greater than the first word length.

16 Claims, 4 Drawing Sheets

SYNTHESIZER AND METHOD USING SCALED EXCITATION SIGNAL

This application claims priority under 35 USC §119(e)(1) of provisional application No. 60/034,169 filed Jan. 02, 1997.

TECHNICAL FIELD OF THE INVENTION

The present invention relates generally to the field of speech processing, and more particularly to an improved synthesizer and method.

BACKGROUND OF THE INVENTION

Educational toys, talking games and similar devices often employ synthesized sound effects and character voices to communication with a user. Such devices have traditionally used linear predictive coding (LPC) techniques to reproduce speech. Linear predictive coding, however, is generally not able to reproduce sophisticated sounds or high quality speech.

More recently, code-excited linear prediction (CELP) systems have been used to provide synthesized speech. CELP systems generally use both fixed and adaptive excitation signals which are combined and synthesized with linear predictive coding (LPC) coefficients. CELP systems are often resource intensive and generally require 16 bit precision. Accordingly, CELP systems are not readily adaptable to many existing speech synthesizer chips.

SUMMARY OF THE INVENTION

Accordingly, a need has arisen in the art for an improved speech synthesizer. The present invention provides a synthesizer and method that substantially reduces or eliminates problems associated with prior speech synthesizers.

In accordance with the present invention, a speech synthesizer may synthesize speech by receiving an adaptive codebook excitation signal and an adaptive codebook gain. The adaptive codebook excitation signal may be scaled using the adaptive codebook gain to generate a scaled adaptive codebook excitation signal. A fixed excitation signal and a fixed excitation gain may also be received. The fixed excitation signal may be scaled using the fixed excitation gain to generate a scaled fixed excitation signal. The scaled adaptive codebook excitation signal and the scaled fixed excitation signal may be combined to generate the excitation signal having a first word length. An overall gain signal of the excitation signal may also be received. A scaled excitation signal may then be generated by scaling the excitation signal using the overall gain signal. The scaled excitation signal may have a second word length greater than the first word length.

More specifically, in one embodiment, the adaptive codebook excitation signal, adaptive codebook gain signal, fixed excitation signal, and fixed excitation gain may comprise the first word length. The scaled adaptive codebook excitation signal and the scaled fixed excitation signal may also comprise the first word length. In a particular embodiment, the first word length may comprise eight (8) bits and the second word length may comprise sixteen (16) bits.

In accordance with another aspect of the present invention, an adaptive codebook may include plurality of entries each containing previous excitation samples. The adaptive codebook may be managed by using a pointer to identify an entry containing an oldest previous excitation sample. The entry identified by the pointer may be overwritten with a current excitation sample. The pointer may then be shifted to identify another entry containing a next oldest previous excitation sample.

More specifically, in accordance with one embodiment, the pointer may be shifted by incrementing the pointer to identify the next entry of the adaptive codebook. In this embodiment, the next entry contains the next oldest previous excitation sample. If the next entry is beyond a last entry of the adaptive codebook, the pointer may be reset to identify the first entry of the adaptive codebook as the next entry.

Important technical advantages of the present invention include providing a high quality synthesizer employing an excitation signal of relatively short word length. In particular, the synthesizer may scale an excitation signal using an overall gain signal to generate a scaled excitation signal having a longer word length. In one embodiment, for example, the synthesizer may scale the excitation signal from eight (8) bits to sixteen (16) bits. Accordingly, the synthesizer provides high quality speech while being readily adaptable to synthesizer chips having limited memory word length.

Other technical advantages of the present invention include providing an improved adaptive codebook. In particular, the adaptive codebook may use a pointer to track entries containing an oldest previous excitation sample. Accordingly, the oldest samples may be continually overwritten with current excitation samples without shifting of the stack of entries. Thus, instruction cycles of the adaptive codebook are reduced and efficiency improved.

Other technical advantages will be readily apparent to one skilled in the art from the following figures, descriptions, and claims.

BRIEF DESCRIPTION OF THE DRAWINGS

For a more complete understanding of the present invention and its advantages thereof, reference is now made to the following description taken in conjunction with the accompanying drawings, wherein like reference numerals represent like parts, in which.

DETAILED DESCRIPTION OF THE INVENTION

The preferred embodiments of the present invention and its advantages are best understood by referring now in more detail to FIGS. 1–5 of the drawings, in which like numerals refer to like parts. As described in more detail below, FIGS. 1–5 illustrate a synthesizer and method employing an overall excitation gain to scale an excitation signal to a longer word length. Accordingly, the synthesizer may provide high quality synthesized speech and be readily used in synthesizer chips having limited memory word length. In accordance with another aspect of the invention, an adaptive codebook and method may employ a pointer to track and overwrite entries containing an oldest previous excitation sample. Accordingly, instruction cycles associated with continually shifting the stack of entries are eliminated and efficiency improved.

Figure 1:
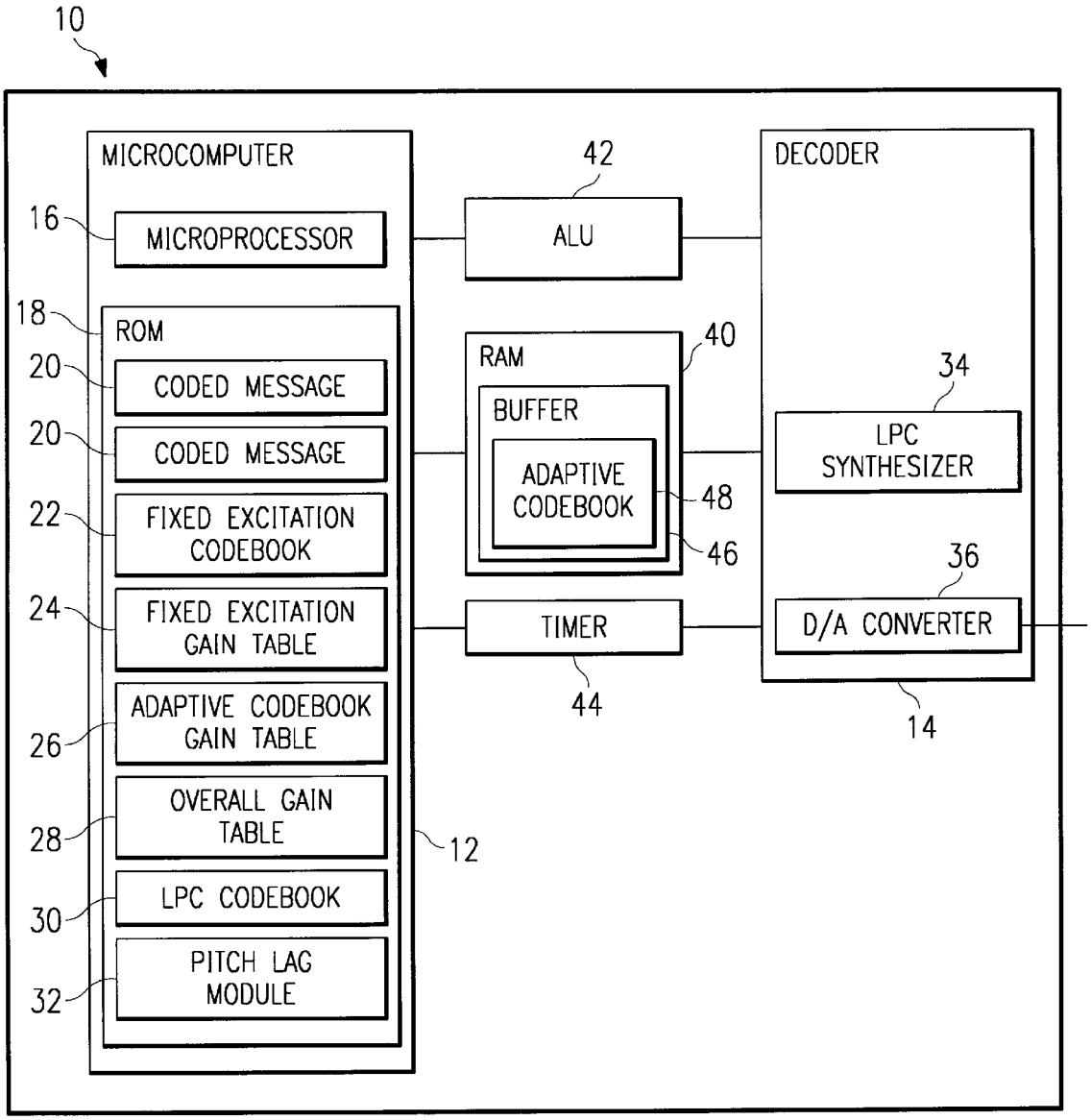
FIG. 1 illustrates a block diagram of a speech synthesizer chip in accordance with one embodiment of the present invention.

FIG. 1 illustrates a block diagram of a synthesizer chip 10 in accordance with one embodiment of the present invention. The synthesizer chip 10 may comprise a microcomputer 12 and a decoder 14. The microcomputer 12 may comprise a microprocessor 16 and ROM memory 18. The ROM memory 18 may include a plurality of coded messages 20. The coded messages 20 may each comprise a bit stream including indices for looking up fixed and adaptive excitation signals, overall gain values, LPC coefficients and pitch lag values of frames, subframes and/or samples of the message 20.

The ROM memory 18 may further include a fixed excitation codebook 22, a fixed excitation gain table 24, an adaptive codebook gain table 26, an overall gain table 28, an LPC codebook 30, and a pitch lag module 32. The fixed excitation consists of selected numbers of equal-amplitude pulses which are specified by their positions and signs. The pulse positions may be encoded individually and directly, at the expense of a slightly higher bit rate. It will be understood that pulse positions of fixed excitation may be otherwise encoded within the scope of the present invention. For example, pulse positions of the fixed excitation may be encoded in pairs to reduce the number of bits required. In this embodiment, however, extra instructions are required to decode the pulse positions.

In this embodiment, the pulses may be encoded in an ascending order such that the first pulse in the bit-stream is the pulse in the lowest position and the last pulse is the one in the highest position. The first pulse in the subframe is encoded in absolute position while the remaining pulses are encoded in offsets to the previous pulse. Where the chip 10 includes a decrementing and underflow feature, the offset of the i-th pulse is coded as follows:

$$\text{offset}(i)=\text{pulse}(i)-\text{pulse}(i-1)-1$$

For example, if there are four pulses at positions 0, 20, 27 and 53, the encoded values will be 0, 19, 6, and 25 respectively. During synthesis, the first absolute pulse position is decremented by one for each sample and it is checked for underflow. If it does not underflow, the fixed excitation signal may be zero (0).

$$\text{fixed}CB(i)=0$$

If it underflows, the synthesizer sets up a pulse for the fixed excitation with amplitude determined by the fixed excitation gain and polarity determined by the sign.

$$fixedCB(i)=\begin{cases} G & \text{sign}=0 \\ -G & \text{sign}=1 \end{cases}$$

The synthesizer may then repeat the same process with the next offset until all pulses have been generated, or in other words, all offsets have been decremented to underflow.

The LPC codebook 30 may comprise LPC coefficients. In one embodiment, the LPC coefficients may be reflection coefficients. In this embodiment, each vector of the LPC codebook 30 may include ten (10) reflection coefficients $K_1$–$K_{10}$, which are encoded individually with scalar quantization. Each reflection coefficient may have its own encoding and decoding table and be encoded in a different number of bits. The decoded values of $K_1$–$K_{10}$ may be obtained by table look-up in the decoding tables using indices provided by the bit stream of the coded message 20.

The fixed excitation gain table 24, adaptive codebook gain table 26 and overall gain table 28 may be scalar quantized. Fixed excitation, adaptive codebook, and overall gain signals may be obtained from the fixed excitation gain table 24, adaptive codebook gain table 26 and overall gain table 28, respectively, by table lookup using indices provided by the bit stream of the coded message 20.

The fixed excitation codebook 22, fixed excitation gain table 24, and adaptive codebook gain table 26 may each comprise a first word length. The overall gain table 28 and the LPC codebook 30 may each comprise a second word length. The overall gain table 28 may comprise overall gain values operable to scale an excitation signal generated from the excitation codebooks from the first word length to the second word length. As described in more detail below, the overall gain codebook 28 allows high quality synthesized speech to be produced by a speech synthesizer chip having limited memory word length.

The pitch lag module 32 may comprise a series of pitch lag values. As described in more detail below, the pitch lag values may be used by an adaptive codebook to determine an adaptive codebook excitation signal. To reduce complexity, the pitch lag module 32 may include only an integer part of a pitch lag. In this embodiment, the pitch lag m in a first subframe of a frame is encoded as (m-M_MIN) where M_MIN is a minimum pitch used for encoding. Pitch lags in other subframes may be encoded as offsets from the previous subframe. In normal cases, the pitch lag of the j-th subframe m(j) is limited to be within the range of (m(j−1)−4) and (m(j−1)+3). In boundary cases when (m(j−1)−4) goes beyond M_MIN or (m(j−1)+3) goes over M_MAX, m(j) may be limited to be within the lower and upper eight values respectively, the pitch lag offset in the j-th subframe may be defined as followed:

$$moffset(j)=\begin{cases} mindex(j) & mindex(j-1)\le 4 \\ mindex(j)-(mindex(j-1)-4) & 4<mindex(j-1)\le(LM-4) \\ mindex(j)-(LM-8) & (LM-4)<mindex(j-1) \end{cases}$$

where mindex(j)=m(j)−M_MIN

LM=M_MAX−M_MIN+1

M_MIN=minimum pitch value (currently used value=22)

M_MAX=maximum pitch value (currently used value=80)

The decoder 14 may include a linear predictive coding (LPC) synthesizer 34 and a conventional digital-to-analog converter 36. The LPC synthesizer 34 is described in more detail below in connection with FIG. 2. The digital-to-analog converter may convert a digital output of LPC synthesizer 34 into an analog format and pass the analog output to an external device such as a speaker.

The synthesizer chip 10 may include a RAM memory 40, an arithmetic and logic unit (ALU) 42 and a timer 44 coupled to the microcomputer 12 and the decoder 14. The RAM memory 40 may include a circular buffer 46. An adaptive codebook 48 may be stored in the circular buffer 46. The adaptive codebook 48 is described in more detail below in connection with FIG. 3. The ALU 42 may carry out mathematical calculations at the request of the microcomputer 12 and the decoder 14. The timer 44 may provide timing functions for the microcomputer 12 and the decoder 14.

In one embodiment, the synthesizer chip 10 may comprise a MSP50C3X chip manufactured by Texas Instruments of Dallas, Tex. The RAM memory 40 of the MSP50C3X chip may be only eight (8) bits wide. In this embodiment, a fixed excitation signal may comprise n pulses per subframe and each pulse may be allocated six bits for its position and one bit for its sign. A fixed excitation gain signal may be allocated five bits per subframe. A pitch lag for determining an adaptive excitation signal may be allocated six bits for the first subframe of a frame and three bits per subframe for other subframes in the same frame. An adaptive gain signal may be allocated four bits per subframe. An overall gain signal may be allocated five bits per frame. For the reflection coefficients, $K_1$ and $K_2$ may each be allocated six bits per frame, $K_3$ and $K_4$ may each be allocated five bits per frame, $K_5$, $K_6$ and $K_7$ may each be allocated four bits per frame. Remaining reflection coefficients $K_8$, $K_9$, and $K_{10}$ may each be allocated three bits per frame. It will be understood that the synthesizer chip 10 may comprise other embodiments and bit allocations within the scope of the present invention.

Figure 2:
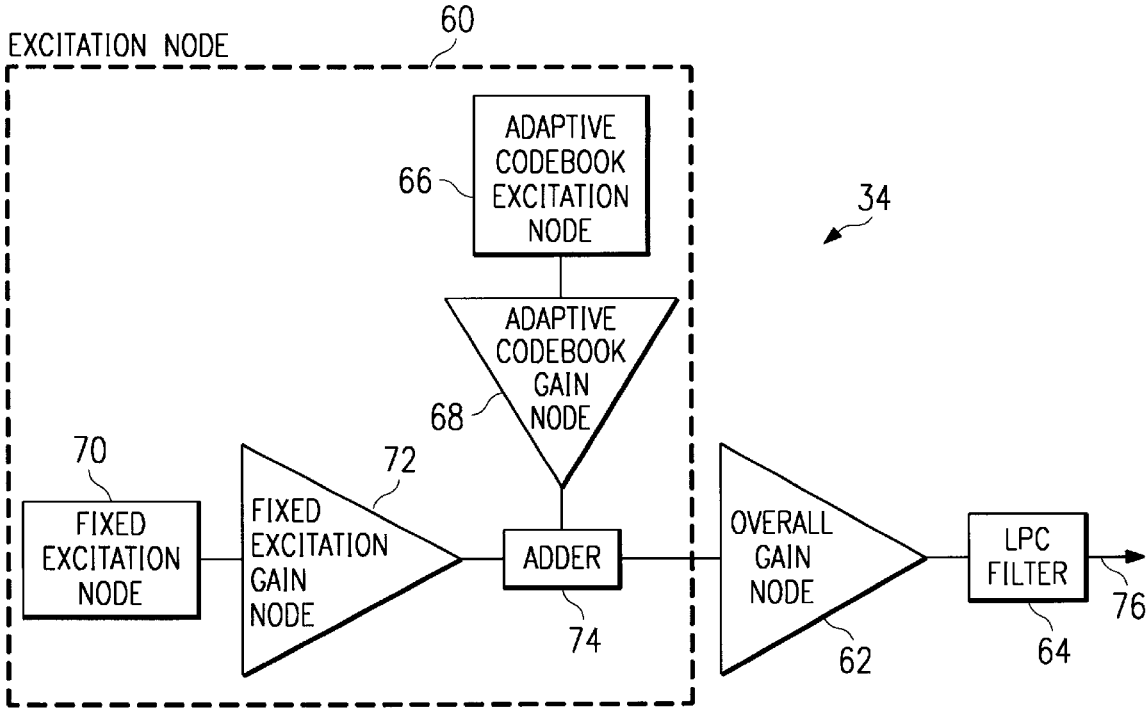
FIG. 2 illustrates a block diagram of a synthesizer of the chip of FIG. 1 in accordance with one embodiment of the present invention.

FIG. 2 illustrates a block diagram of the synthesizer 34 in accordance with one embodiment of the present invention. The synthesizer 34 may be a linear predictive coding (LPC) synthesizer. The synthesizer 34 may comprise an excitation node 60, an overall gain node 62 and a LPC filter 34. It will be understood that the synthesizer 34 may not comprise separate structures for the nodes and that the nodes are shown for the convenience of the reader. The excitation node 60 may be operable to receive an excitation signal having a first word length. The overall gain node 62 may be operable to receive an overall gain signal of the excitation signal. The overall gain node 62 may be operable to scale the excitation signal using the overall gain signal to generate a scaled excitation signal having a second word length greater than the first word length. In one embodiment, the first word length may comprise eight (8) bits and the second word length may comprise sixteen (16) bits. By varying the overall gain frame-by-frame, high level signals may be limited to be within eight bits by using a large value of the overall gain, while at the same time the significance of low level signals may be maintained by using a small value of the overall gain. Accordingly, the synthesizer 34 may provide high quality speech using a short word length excitation signal.

The excitation node 60 may comprise an adaptive codebook excitation node 66, an adaptive codebook gain node 68, a fixed excitation node 70, a fixed excitation gain node 72 and an adder 74. The adaptive codebook excitation node 66 may be operable to receive an adaptive codebook excitation signal from the adaptive codebook 48. The adaptive codebook gain node 68 may be operable to receive an adaptive codebook gain from the adaptive codebook gain table 26. The adaptive codebook gain node 68 may scale the adaptive codebook excitation signal using the adaptive codebook gain to generate a scaled adaptive codebook excitation signal. The adaptive codebook excitation signal may be scaled by multiplying it by the adaptive codebook gain. The fixed excitation node 70 may be operable to receive a fixed excitation signal from the fixed excitation codebook 22. The fixed excitation gain node 72 may be operable to receive a fixed excitation gain from the fixed excitation gain table 24. The fixed excitation gain node 72 may scale the fixed excitation signal using the fixed excitation gain to generate a scaled fixed excitation signal. The fixed excitation signal may be scaled by multiplying it by the fixed excitation gain. The adder 74 may be operable to combine the scaled adaptive codebook excitation signal and the scaled fixed excitation signal to generate the excitation signal of the excitation node 60.

The LPC filter 64 may be operable to receive reflection coefficients from the LPC codebook 30. The LPC filter 64 may synthesize the scaled excitation signal using the reflection coefficients to generate a synthesized signal 76. The synthesized signal 76 may be converted by the digital-to-analog converter 36 and transmitted to an external device.

For the MSP50C3X chip, the overall gain node 62 may form part of the LPC filter 64. In this embodiment, the overall gain may be input directly into the LPC filter. Accordingly, both scaling and filtering are performed by the hardware filter so that no programming effort is required for these operations. In this embodiment, the adaptive codebook excitation node 66, adaptive codebook gain node 68, fixed excitation node 70, fixed excitation gain node 72 and adder 74 may comprise subroutines. It will be understood that the overall gain node 62 may also comprise a subroutine. Computations performed by the subroutines may simulate fixed-point arithmetic to preserve precision of the MSP50C3X chip 10.

Figure 3:
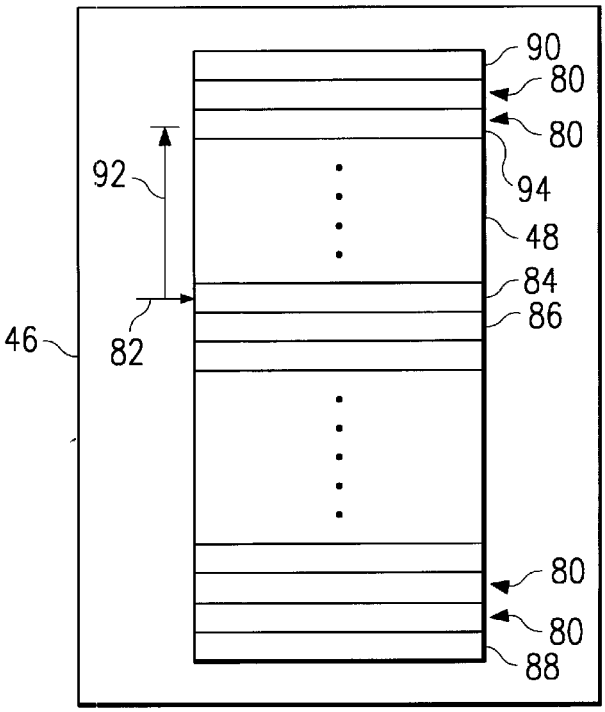
FIG. 3 illustrates a block diagram of an adaptive codebook in accordance with one embodiment of the present invention.

FIG. 3 illustrates a block diagram of the adaptive excitation codebook 48 in the circular buffer 46 of the RAM memory 40. The buffer 46 should be large enough to store the excitation history which size is equal to the maximum pitch value plus the subframe size.

The adaptive codebook 48 may comprise a plurality of entries 80, each containing a previous excitation sample. A pointer 82 may be operable to identify an entry 84 containing an oldest previous excitation sample. The adaptive codebook 48 may overwrite the identified entry 84 with a current excitation sample generated by the CELP synthesizer 34. The adaptive codebook 48 may then shift the pointer 82 to identify another entry containing a next oldest previous excitation sample.

In one embodiment, the pointer 82 may be shifted by incrementing the pointer 82 to identify a next entry 86 of the adaptive codebook 48. In this embodiment, the next entry 86 contains the next oldest previous excitation sample. Accordingly, the pointer 82 will move down the entries 80 of the adaptive excitation codebook 48 to continually identify and overwrite entries containing the oldest previous excitation samples. If the next entry 86 is beyond a last entry 88 of the adaptive codebook 48, the pointer 82 may be reset to identify a first entry 90 as the next entry 86. Thus, when the pointer 82 has reached the bottom of the adaptive codebook 48, it is reset to the beginning of the adaptive codebook 48. As a result, entries 80 need not be shifted each time a current excitation signal is received by the adaptive codebook 48. Thus, the efficiency of the adaptive codebook 48 is improved.

A pitch lag 92 may be used to identify an entry 94 of the adaptive codebook 48 containing a previous excitation signal to be used by the synthesizer 34 as the adaptive codebook excitation signal. As previously described, to reduce complexity, only integer pitch lags are used in the adaptive codebook 48 search. Additionally, the maximum allowable pitch lag may be limited to 80 to limit the size of the buffer 46. As previously described, the size of the buffer 46 may equal the largest pitch lag plus the subframe size.

Figure 4:
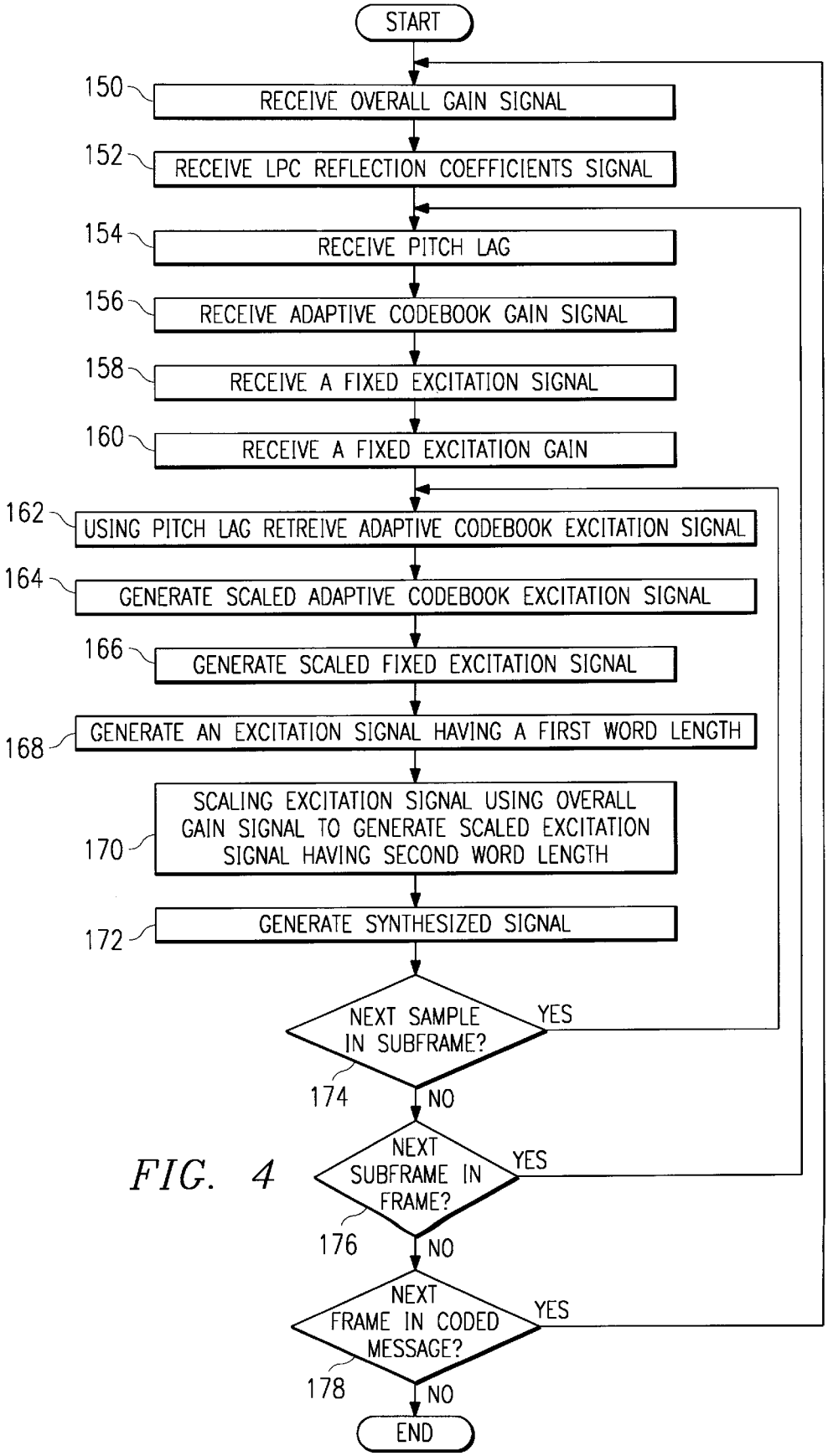
FIG. 4 illustrates a flow diagram of a method of providing synthesized speech using the synthesizer of FIG. 2 in accordance with one embodiment of the present invention.

FIG. 4 illustrates a flow diagram of a method of synthesizing speech in accordance with the one embodiment of the present invention. The method begins at step 150 wherein an overall gain signal may be received from the overall gain codebook 28. Proceeding to step 152, LPC reflection coefficients are received from the LPC codebook 30. The overall gain signal and LPC reflection coefficients received at steps 150 and 152 may be reused for the subframes and samples of a frame.

In another embodiment, the LPC reflection coefficients may be linearly interpolated for each subframe. Because a stable LPC filter 64 is guaranteed if the reflection coefficients range between −1 and 1, interpolation will preserve stability. The interpolated $K_i(j)$ for the j-th subframe(j)=0, 1, . . . , n subframe-1 is given by:

$$K_i(j) = \frac{(j+l)K_i + (nsubframe - j - l) - K_i^{(last)}}{nsubframe}$$

Proceeding to step 154, a pitch lag may be received from the pitch lag module 32. Next, at step 156, an adaptive codebook gain may be received from the adaptive codebook gain table 26. Next, at step 158, a fixed excitation signal may be received from the fixed excitation codebook 22. At step 160, a fixed excitation gain may be received from the fixed excitation gain table 24. The pitch lag, adaptive codebook gain signal, fixed excitation signal, and fixed gain excitation signal may be reused for samples of a subframe.

At step 162, the pitch lag may be used to retrieve an adaptive codebook excitation signal from the adaptive codebook 48. Next, at step 164, the adaptive codebook gain may be used to scale the adaptive codebook excitation signal to generate a scaled adaptive codebook excitation signal. As previously described, the adaptive codebook gain node 68 may scale the adaptive codebook excitation signal to generate the scaled adaptive codebook excitation signal.

Next, at step 166, the fixed excitation gain may be used to scale the fixed excitation signal to generate a scaled fixed excitation signal. As previously described, the fixed excitation gain node 72 may scale the fixed excitation signal to generate the scaled fixed excitation signal.

As previously described, the scaled adaptive excitation signal and the scaled fixed excitation signal may both comprise a first word length. The first word length may comprise eight (8) bits. Proceeding to step 168, an excitation signal having the first word length may be generated by combining the scaled adaptive codebook excitation signal and the scaled fixed excitation signal. Next, at step 170, the excitation signal may be scaled using the overall gain signal to generate a scaled excitation signal having a second word length. The second word length may comprise sixteen (16) bits.

Proceeding to step 172, a synthesized signal may be generated. The synthesized signal may be generated by synthesizing the scaled excitation signal in the LPC filter 64 using the reflection coefficients. Step 172 leads to decisional step 174.

At decisional step 174, it is determined if a next sample exists for the current subframe. If a next sample exists for the current subframe, the YES branch of decisional step 174 returns to step 162 wherein an adaptive codebook excitation signal is retrieved from the adaptive codebook 48 for the next sample. If a next sample does not exist for the current subframe, the NO branch of decisional step 174 leads to decisional step 176.

At decisional step 176, it is determined if a next subframe exists for the current frame. If a next subframe exists for the current frame, the YES branch of decisional step 176 returns to step 154 wherein a pitch lag is received for the next subframe. If a next subframe does not exist for the current frame, the NO branch of decisional step 176 leads to decisional step 178.

At decisional step 178, it is determined if a next frame exists for the coded message 20. If a next frame exists for the coded message 20, the YES branch of decisional step 178 returns to step 150 wherein an overall gain signal is received from the overall gain table 28 for the next frame. If a next frame does not exist for the coded message 20, the NO branch of decisional step 178 leads to the end of the program.

Accordingly, the overall gain signals and LPC reflection coefficients may be reused for the subframes and samples of a frame. The pitch lag, adaptive codebook gain signal, fixed excitation signal, and fixed excitation gain signal may be reused for the samples of a subframe. In each sample, however, a new adaptive codebook excitation signal is received using the pitch lag. Additionally in each sample, a new scaled adaptive codebook excitation sample, scaled fixed excitation sample, excitation sample and scaled excitation sample are determined by the synthesizer 34. It will be understood that the signals reused by subframes and samples of a frame may vary within the scope of the present invention.

For the MSP50C3X chip embodiment, the subframe size, number of subframes per frame, number of pulses per subframe, memory requirement and resulting bit rate may be varied. In one embodiment, the subframe size may be 64, the number of subframes per frame may be two (2), the number of pulses per subframe may be four (4), the bit rate in this case is 8.2 kb/s and the RAM required for buffers may include 190 locations. In a lower bit rate embodiment, the subframe size may be 64, the number of subframes per frame may be four (4), the number of pulses per subframe may be three (3), and the bit rate in this case is 5.7 kb/s. The RAM required may be as described in the previous embodiment. In a higher bit rate embodiment, the subframe size may be 40, the number of subframes per frame may be two (2), the number of pulses per subframe may be four (4) and the bit rate may be 13.1 kb/s. This embodiment RAM required for buffers may include 160 locations.

Figure 5:
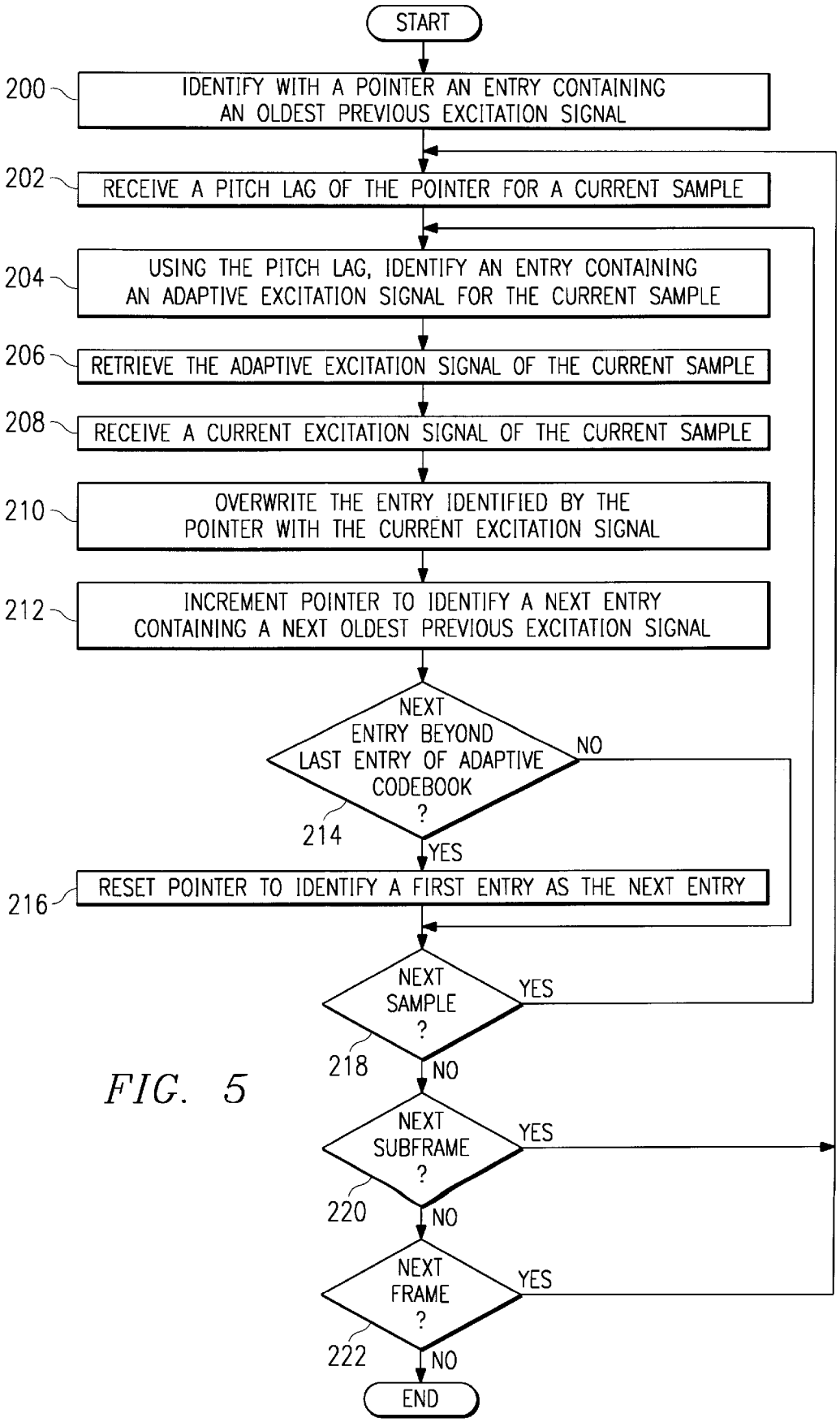
FIG. 5 illustrates a flow diagram of a method of managing the adaptive codebook of FIG. 3 in accordance with one embodiment of the present invention.

FIG. 5 illustrates a flow diagram of a method of managing the adaptive codebook 48. The method begins at step 200 wherein the pointer 82 identifies an entry 84 containing an oldest previous excitation sample. Proceeding to step 202, a pitch lag 92 may be received from the pitch lag module 32 for a current subframe of the coded message 20.

Next, at step 204, the entry 94 containing the adaptive codebook excitation signal for the current sample may be identified using the pitch lag 92. The pitch lag 92 is used as an offset to the pointer 82. At step 206, the adaptive codebook excitation signal identified by the pitch lag 92 may be retrieved. The adaptive codebook excitation signal may be used by the synthesizer 34 to generate an excitation signal that may be scaled and synthesized to provide synthesized speech. The excitation signal generated by the synthesizer 34 may also be fed back to the adaptive codebook 48 to update the excitation history. At step 210, the adaptive codebook 48 may overwrite the entry 84 identified by the pointer with the current excitation sample received from the synthesizer 34.

Next, at step 212, the pointer 82 may be incremented to identify the next entry 86 containing the next oldest previous excitation sample. At decisional step 214, it may be determined if the next entry 86 is beyond the last entry 88 of the adaptive codebook 48. If the next entry 86 is beyond the last entry 88, the YES branch leads to step 216. At step 216, the pointer 82 may be reset to identify the first entry 90 as the next entry 86. Step 216 leads to decisional step 218. Returning to decisional step 214, if the next entry 86 is not beyond the last entry 88, the NO branch of decisional step 214 also leads to decisional step 218.

At decisional step 218, it is determined if a next sample exists for the current subframe. If a next sample exists, the YES branch of decisional step 218 returns to step 204 where an entry containing an adaptive codebook excitation signal for the next, now current, sample is identified by the pitch lag. Because the pointer 82 has been incremented, the adaptive codebook excitation signal may differ from the previous sample. If a next sample does not exist for the current subframe, the NO branch of decisional step 218 leads to decisional step 220.

At decisional step 220, it may be determined if a next subframe exists for the current frame. If a next subframe exists, the YES branch of decisional step 220 returns to step 202 wherein a pitch lag of the next, now current subframe is received. If a next subframe does not exist for the current frame, the NO branch of decisional step 220 leads to a decisional step 222.

At decisional step 222, it is determined if a next frame exists for the coded message 20. If a next frame exists, the YES branch of decisional step 222 also returns to step 202 wherein a pitch lag is received for the first subframe of the next, now current, frame. If a next frame does not exist, the NO branch of decisional step 222 leads to the end of the process. Accordingly, a pitch lag value may be reused for samples of a subframe and a new pitch lag may be received for each new subframe and frame.

Although the present invention has been described with several embodiments, various changes and modifications may be suggested to one skilled in the art. It is intended that the present invention encompass such changes and modifications as fall within the scope of the appended claims.

What is claimed is:

1. A method of synthesizing speech, comprising the steps of:

receiving a pitch lag;

retrieving an adaptive codebook excitation signal from an adaptive codebook using the pitch lag;

receiving an adaptive codebook gain;

scaling the adaptive codebook excitation signal using the adaptive codebook gain to generate a scaled adaptive codebook excitation signal;

receiving a fixed excitation signal;

receiving a fixed excitation gain;

scaling the fixed excitation signal using the fixed excitation gain to generate a scaled fixed excitation signal;

combining the scaled adaptive codebook excitation signal and the scaled fixed excitation signal to generate an excitation signal having a first word length;

receiving an overall gain signal of the excitation signal; and scaling the excitation signal using the overall gain signal to generate a scaled excitation signal having a second word length greater than the first word length.

2. The method of claim 1, wherein the first word length comprises eight (8) bits and the second word length comprises sixteen (16) bits.

3. The method of claim 1, wherein the adaptive codebook excitation signal, adaptive codebook gain, fixed excitation signal, and fixed excitation gain comprise the first word length.

4. The method of claim 3, wherein the first word length comprises eight (8) bits and the second word length comprises sixteen (16) bits.

5. The method of claim 3, wherein the scaled adaptive codebook excitation signal and the scaled fixed excitation signal comprise the first word length.

6. The method of claim 5, wherein the first word length comprises eight (8) bits and the second word length comprises sixteen (16) bits.

7. The method of claim 1, further comprising the steps of:

receiving an LPC coefficients signal; and synthesizing the scaled excitation signal using the LPC coefficients signal to generate a synthesized signal.

8. The method of claim 1, wherein the LPC coefficients are reflection coefficients.

9. The method of claim 7, wherein the LPC coefficients signal and the synthesized signal comprise the second word length.

10. The method of claim 9, wherein the first word length comprises eight (8) bits and the second word length comprises sixteen (16) bits.

11. A code-excited linear prediction (CELP) synthesizer, comprising:

an excitation node operable to receive an excitation signal having a first word length;

an overall gain node operable to receive an overall gain signal of the excitation signal; and the overall gain node operable to scale the excitation signal using the overall gain signal to generate a scaled excitation signal having a second word length greater than the first word length.

12. The CELP synthesizer of claim 11, wherein the first word length comprises eight (8) bits and the second word length comprises sixteen (16) bits.

13. The CELP synthesizer of claim 11, further comprising:

an adaptive codebook excitation node operable to receive an adaptive codebook excitation signal;

an adaptive codebook gain node operable to receive an adaptive codebook gain and to scale the adaptive codebook excitation signal using the adaptive codebook gain to generate a scaled adaptive codebook excitation signal;

a fixed excitation node operable to receive a fixed excitation signal;

a fixed excitation gain node operable to receive a fixed excitation gain and to scale the fixed excitation signal using the fixed excitation gain to generate a scaled fixed excitation signal; and an adder operable to combine the scaled adaptive codebook excitation signal and the scaled fixed excitation signal to generate the excitation signal.

14. The CELP synthesizer of claim 13, wherein the adaptive codebook excitation signal, adaptive excitation gain, scaled adaptive codebook excitation signal, fixed excitation signal, fixed excitation gain, and scaled fixed excitation signal comprise the first word length.

15. The CELP synthesizer of claim 13, further comprising:

an adaptive codebook, comprising:

a plurality of entries each containing previous excitation samples;

a pointer operable to identifying an entry containing an oldest previous excitation sample;

the adaptive codebook operable to overwrite the identified entry with a current excitation sample; and the adaptive codebook operable to shift the pointer to identify another entry containing a next oldest previous excitation sample.

16. The CELP synthesizer of claim 11, further comprising:

a linear predictive coding (LPC) filter operable to receive a reflection coefficients signal;

the LPC filter operable to receive the scaled excitation signal; and the LPC filter operable to synthesize the scaled excitation signal using the reflection coefficients to generate a synthesized signal.

* * * * *